US012588725B2

(12) United States Patent
Hume et al.

(10) Patent No.: US 12,588,725 B2
(45) Date of Patent: Mar. 31, 2026

(54) VISOR BOARD FOR USE WITH HEADGEAR BRIM

(71) Applicant: Rustek Collective LLC, Portland, OR (US)

(72) Inventors: Clayton Hume, Portland, OR (US); Miles Hume, Portland, OR (US)

(73) Assignee: Rustek Collective LLC, Portland, OR (US)

( * ) Notice: Subject to any disclaimer, the term of this patent is extended or adjusted under 35 U.S.C. 154(b) by 0 days.

(21) Appl. No.: 18/235,781

(22) Filed: Aug. 18, 2023

(65) Prior Publication Data

US 2025/0057273 A1 Feb. 20, 2025

Related U.S. Application Data

(60) Provisional application No. 63/399,229, filed on Aug. 19, 2022.

(51) Int. Cl.
*A42B 1/0183* (2021.01)
*A42B 1/201* (2021.01)

(52) U.S. Cl.
CPC ..... *A42B 1/0183* (2021.01)

(58) Field of Classification Search
CPC ..... A42B 1/0183
See application file for complete search history.

(56) References Cited

U.S. PATENT DOCUMENTS 632,531 A * 9/1899 Lehman ..... A42C 1/06 83/563
1,027,685 A * 5/1912 Bloom ..... B65D 41/02 215/334
1,214,876 A * 2/1917 Axelman ..... A45C 5/02 190/126
2,181,180 A * 11/1939 Feige ..... A42C 5/04 2/171.1
2,335,706 A * 11/1943 St Clair ..... A45D 44/12 2/174
2,716,753 A * 9/1955 Gordon ..... A42B 1/201 2/172
4,104,103 A * 8/1978 Tarullo ..... C09J 5/06 156/332
6,648,363 B2 * 11/2003 Gordon ..... A63C 17/01 280/610
8,820,042 B1 * 9/2014 Timson ..... A01D 7/08 56/400.17
11,033,769 B2 * 6/2021 Yin ..... A63B 23/03533
11,100,906 B1 * 8/2021 Mohr ..... G10D 3/16
11,919,266 B2 * 3/2024 Ha ..... B32B 5/022
2004/0078868 A1 * 4/2004 Kercher ..... D06P 1/5235 2/171
2005/0223475 A1 * 10/2005 Turner ..... A42B 1/22 2/209.4
2005/0235395 A1 * 10/2005 Tseng ..... A42B 1/0182 2/175.1
2006/0174397 A1 * 8/2006 Taguchi ..... A42B 1/0182 2/195.6

(Continued)

*Primary Examiner* — Robert H Muromoto, Jr.
(74) *Attorney, Agent, or Firm* — Intellectual Innovations Legal Advisors

(57) ABSTRACT

A visor board for use in a headgear brim comprising a multilayer structure having a layer of cork and a layer of a strengthening material laminated to the layer of cork. Other material combinations for a visor board of a headgear brim are provided.

16 Claims, 12 Drawing Sheets

Visor Board

(56) References Cited

U.S. PATENT DOCUMENTS

| | | | | |
|---|---|---|---|---|
| 2006/0218688 | A1* | 10/2006 | Cheng | A61F 9/04 2/12 |
| 2011/0036042 | A1* | 2/2011 | Slaven, Jr. | E04C 3/16 52/745.19 |
| 2013/0212777 | A1* | 8/2013 | Leon | A42B 1/201 2/181 |
| 2018/0273252 | A1* | 9/2018 | Bernasconi | B32B 9/045 |
| 2021/0069541 | A1* | 3/2021 | Yin | A63B 21/0455 |
| 2021/0145108 | A1* | 5/2021 | Starks | A42C 5/04 |
| 2021/0212491 | A1* | 7/2021 | Augustin | E01B 3/46 |
| 2023/0329391 | A1* | 10/2023 | Park | B29D 35/142 |

* cited by examiner

Visor Board

VISOR BOARD FOR USE WITH HEADGEAR BRIM

CROSS REFERENCE TO RELATED APPLICATION

This application claims priority to U.S. provisional patent application Ser. No. 63/399,229 filed Aug. 19, 2022, the entire content of which is incorporated herein by this reference.

FIELD OF THE INVENTION

This invention relates generally to headgear, and more particularly to visor boards for use in a headgear brim.

BACKGROUND OF THE INVENTION

Headgear is generally defined as a covering for a person's head, including as a fashion statement, protection from the sun, keeping warm, sanitation such as while cooking, and protection from other external elements. Headgear can include hats, caps and visors. Some headgear, such as a baseball caps, have a brim. The brim can serve to shade all or part of the wearer's eyes, face, head or neck to minimize sun exposure.

A headgear brim is often comprised of a visor board. The fabric of the headgear often encloses the visor board for aesthetic purposes. The visor board is a rigid or flexible material used to provide the shape and structure of the brim element. Visor boards are typically sewable, flexible, and have some ability to return to their original shape, sometimes referred to as 'rebound.' The visor board is the structural support of the brim, and is distinctly separate from the brim fabric that overlies the visor board.

Typically, visor boards have been made from plastic, foam, cardboard, or solid wood. However, plastic is not biodegradable, which means that discarded hats add to the pollution of the Earth. In addition, plastic visor boards can be permanently deformed when bent in excess of a threshold pressure. Cardboard is not waterproof nor water-resistant, making a cardboard visor board prone to water damage. Additionally, cardboard can break, fold and split when improperly or excessively bent, permanently disfiguring the structure of a brim. Solid wood is heavy, difficult to mold or shape, not waterproof or water-resistant, and not sewable in industrial machines, rendering it not viable as a replacement for plastic visor boards.

Laminated cork fabrics have been used as the fabric enclosing visor boards, for example in hat production. The enclosing fabric is a separate brim component from the visor board.

There is a need for a visor board of new material that overcome the foregoing challenges and obstacles.

BRIEF DESCRIPTION OF THE DRAWINGS

The drawings described herein are for illustration purposes only and are not intended to limit the scope of the present disclosure in any way.

DETAILED DESCRIPTION OF THE INVENTION

Figure 1A:
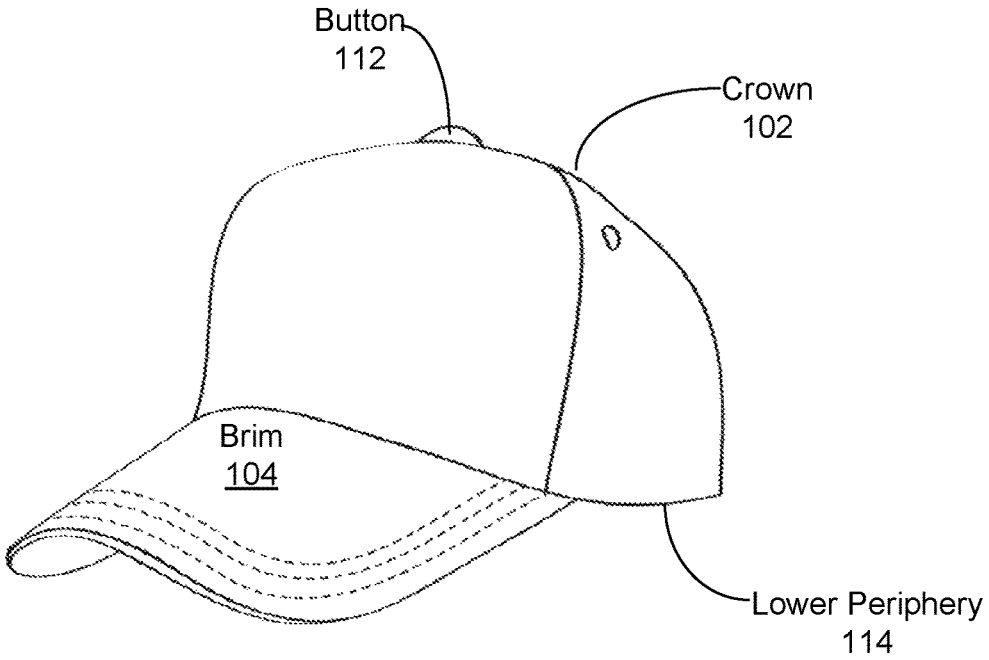
FIG. 1A is a front perspective view of a cap.

The invention is applicable to a visor board and any type of headgear having a brim that includes a visor board as the structure of the brim, including caps, baseball caps, visors and tennis visors.

A visor board of the invention can optionally include a multilayer structure having at least one layer of cork and may optionally include a layer of a strengthening material laminated to the layer of cork. A textile layer overlying the multilayer structure can optionally be provided for providing a desired aesthetic appearance. The cork can optionally be solid cork, agglomerated cork or both. The agglomerated cork can optionally include cork particles, including cork granules or larger pieces, agglomerated with a binder that can optionally be a polyurethane, polyvinyl acetate (PVA) glue, rubber, natural rubber, nylon, adhesive, plastic, thermoplastic or any combination of the foregoing. The visor is optionally bendable. The strengthening material can optionally be bamboo, a multilayer bamboo structure, a fabric, a textile, a natural material, wood, jute, paper, plastic, foam, plastic free foam or any combination of the foregoing.

The visor board of the invention can optionally include a multilayer structure of a layer of foam or foam-like material, for example foam material that is sewable in an industrial process and bendable, and a layer of bamboo laminated to the layer of the material for providing strength to the multilayer structure. The foam or foam-like material can optionally have a memory for permitting the material to retain a shape. The foam or foam-like material can optionally be heat moldable. The foam or foam-like material can optionally be cork, agglomerated cork, a plastic-free foam, foam, a natural material, a sewable material, a sewable substrate or any combination of the foregoing.

The visor board of the invention can optionally include a least one layer of agglomerated cork. The agglomerated cork can optionally include cork particles, including cork granules or larger pieces, agglomerated with a binder that can optionally be a polyurethane, PVA glue, rubber, natural rubber, nylon, adhesive, plastic, thermoplastic or any combination of the foregoing, As used herein, the term sewable layer means any layer of a material that can be sewn in an industrial sewing machine.

The layer of material can optionally be sewn in an industrial sewing machine without splintering, fragmenting or causing other permanent undue damage to the material.

A visor board of the invention can optionally be constructed from solid cork, or one or more layers of cork, directly or indirectly laminated or bonded to other materials. Cork is one of the few naturally occurring materials suitable for brim construction, as it is sewable, flexible, waterproof, and exhibits rebound properties. However, solid and agglomerated cork can be prone to cracking and breaking under the stress undergone in the life of a hat brim. A laminated construction takes advantage of the best properties of cork for hat brim construction, while minimizing or eliminating durability and breakage concern, by providing additional strength, rebound and structural integrity expected from a hat brim via the inherited properties of the laminated materials and lamination process.

Cork is a foam with closed cells, formed by empty lumens and suberized cell walls. The presence of suberin is a specific characteristic of cork and often used to identify cork cells in plant anatomy by applying specific suberin staining, for example using a sudan dye. Cork has low density, low permeability to fluids, a low thermal coefficient, and considerable durability. Cork is buoyant, and exhibits elasticity without fracturing under compression. Such characteristics result from the features of its cellular structure, primarily its cell dimensions and topology, and from the chemical composition of the cell wall. Though cork can appear porous, its unique cellular structure makes it hydrophobic and resistant to liquids.

As discussed, cork is advantageous because it is sewable, for example in an industrial sewing machines without splintering or fragmenting. Cork can be advantageous because it is heat moldable. Cork can be advantageous because it is self-adhesive. Cork can be advantageous because it permits the production of a curved brim style, including without the use of plastic, synthetic glues or extrusion molding. A layer of cork may optionally be stabilized when used with an additional material, which can include fabric, bamboo, wood, jute, certain other natural materials and any combination of the foregoing. A cork layer in the brim can permit the stabilizing materials of the visor board to be sewn in an industrial sewing machines without splintering or fragmenting. Producing visor boards for headgear with cork can result in a significant reduction of plastic pollution in the fashion industry, given that headgear with brims, specifically those using visor boards, are one of the world's most popular fashion accessories and merchandise items.

A visor board having cork may exhibit water-resistance due to the cork material. A cork visor board, optionally including bamboo, fabric or a natural or other strengthening material, can be heat-molded to a wearer's preferred curvature for a lasting fit. Because cork and bamboo are buoyant and float on the surface of water, the brim may be easily retrieved from natural waterways to reduce pollution. Cork advantageously has antimicrobial properties, which can make cork brims suitable for athletic applications, outdoor settings where exposure to water and moisture, including for example sweat, is likely. A cork brim, with an optional bamboo or a natural or other strengthening layer, construction meets or exceeds the performance of plastic brims in many measurable attributes, including for example flex, heat-moldability, and comfort. In addition, cork visor board may benefit from the flex, durability, and rebound properties from bamboo, fabric or other laminated materials.

Bamboo and multi-layer laminated bamboo constructions can exhibit 'directional flex,' allowing the material to bend along one axis, and resist bending along the other axis, which when combined with cork can create optimal flex for hat brims. Bamboo exhibits exceptional rebound and strength, for example two or three times that of wood), allowing for thin layers suitable for visor board construction, making it an advantageous choice for lamination in cork brims. Similar properties may be observed in wood, certain textiles and other natural materials.

In the instance of a construction of cork laminated to a fabric or textile, the fabric or textile can lend surface tension to the laminated construction, providing durability and rebound to the construction, limiting the amount the visor board will bend, allowing the cork to avoid cracking and breaking when bent, and providing additional rebound to return to the original shape after bending. The fabric may absorb bending force to minimize brim damage. The heat moldable character of the cork material can permit construction of a curved brim that is flexible in multiple directions, allowing for a crushable, packable design that can rebound to its intended or original form. These properties make this construction a suitable replacement for foam brims, common in athletic and travel applications for their flexible, packable properties.

Headgear visor boards comprising cork may be water-resistant and easily moldable under high heat, making cork a suitable substitute for plastic or cardboard brim constructions. The flex and rebound properties of a cork visor board can be modulated with the addition of one or more layers of a suitable strengthening material, including fabric, bamboo, wood, jute, other natural materials or any combination of the foregoing.

Figure 1B:
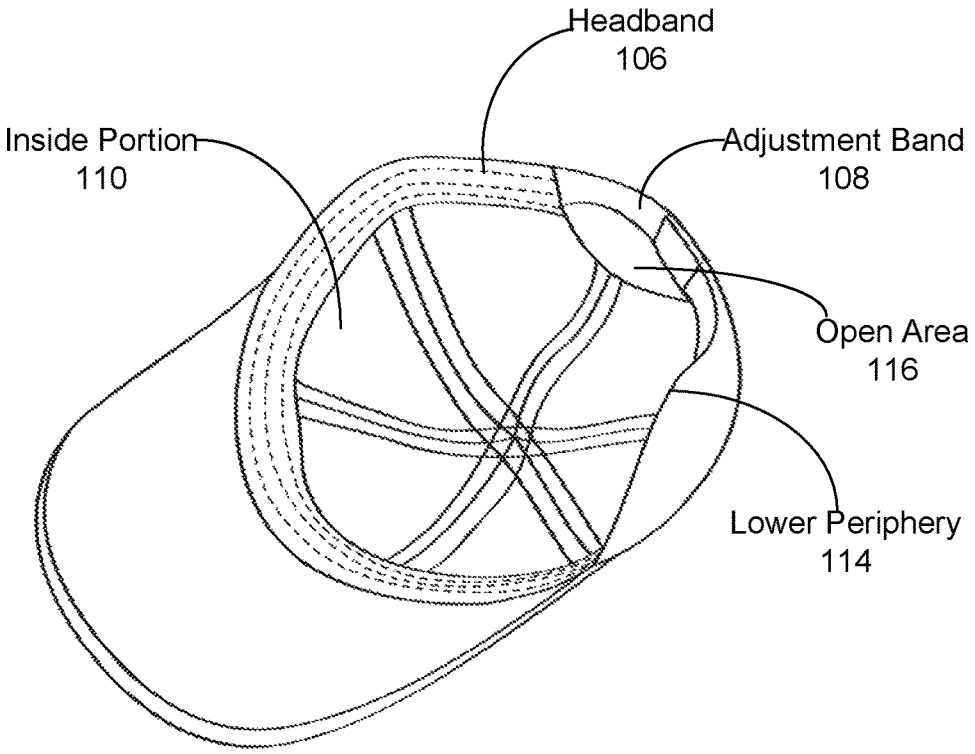
FIG. 1B is a bottom perspective view of a cap.

FIGS. 1A and 1B are a front perspective view and a bottom perspective view of a cap, respectively. The cap, which can optionally be referred to as a hat or baseball cap, can optionally comprise a head-engaging portion or crown 102, a visor or brim 104, a headband 106, and an adjustment band 108. Adjustment band 108 may optionally include any mechanical means for modifying a fit of the hat to a wearer's head size. Such mechanical means can optionally include a Velcro strap, snap fasteners, clasp or buckle. Brim 104 may be physically attached to a front side periphery of the crown 102, for example sewn onto crown 102. An optional open area 116 may be disposed above adjustment band 108 to facilitate the modification of adjustment band 108. Headband 106 may be attached by any suitable means, for example sewn, to a circumferential lower inside rim of the crown 102. The headband can optionally be configured to conform to the wearer's head such that it lies flat against the wearer's head. The headband can optionally be configured to absorb sweat. An upper portion of headband 106 can optionally be secured in place at several locations, typically through sewing, such that the band cannot flop outwardly when a wearer removes the hat.

An inside portion 110 of the crown 102 may be reinforced, for example mechanically, materially or both, for maintaining its shape. As shown, crown 102 can be optionally formed of a plurality of triangular segments or gores, for example six, that are sewn together to provide a dome shape adapted to cover the top of a wearer's head. The gores may be made of various fabrics commonly used in the industry. In some cases, alternatively to using adjustment band 108, one or more gores at the rear of crown 102 may be made of a fabric that is elastic in the direction of the lower periphery 114 such that that crown 102 can be stretched to fit a range of head sizes. The intersection of the stitching at the uppermost point of the crown 102 may optionally be covered with a decorative button 112, which may be sewn or stapled to crown 102. The outside of crown 102 can be visible to a viewer when the hat is worn on a wearer's head, while the inside portion 110 of crown 102 can face the wearer's head and not be visible to the viewer. The opening of crown 102 can optionally be defined by a generally horizontal lower periphery 114. Crown 102 optionally has a vertical central axis that extends through the topmost point, for example the decorative button 112, of crown 102 and perpendicularly to lower periphery 114. Crown 102 may optionally comprise one or more decorative symbols, letters, badges, words or any combination thereof, for example a patch "B" embodying a logo of a sports team. The various designs may be stitched into, sewn on or otherwise incorporated to crown 102 of the cap assembly.

Brim 104 may comprise an upper surface fabric, a lower surface fabric, a visor board, and a proximate portion that is removably, adjustably or permanently secured to crown 102. Brim 104 may extend substantially horizontally, and away from crown 102 such that it provides shade from sunlight for a wearer's eyes, face, head, neck or any combination of the foregoing. The purpose for which the hat, or other headgear, is to be used may dictate brim 104's shape, length and angle. For example, brim 104 may be curved or bent along the direction from periphery 114 of crown 102 to the farthest edge of brim 104 in order to get more light coverage over the corners of a wearer's eyes.

Figure 2:
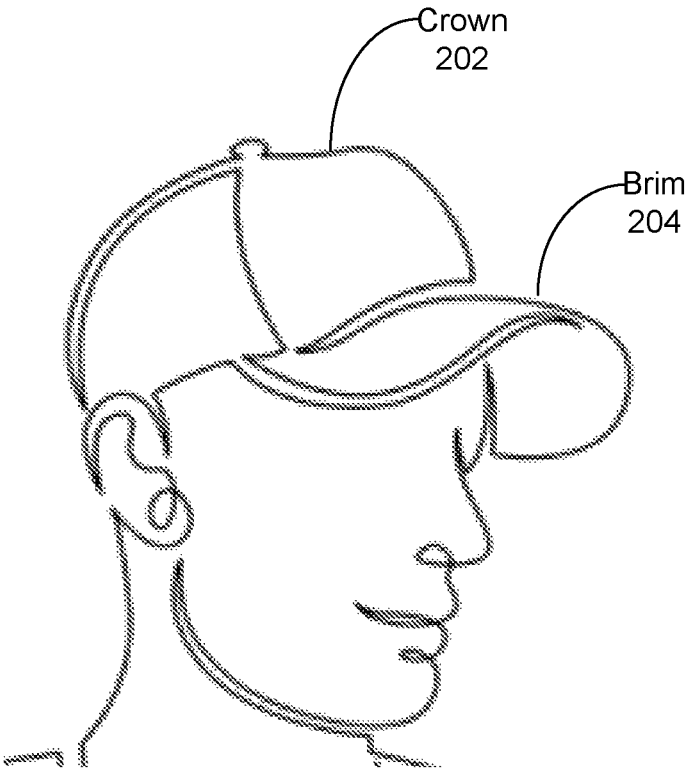
FIG. 2 shows a cap on a head of a wearer.

FIG. 2 shows a cap, for example a baseball cap or hat, being worn on a head of a wearer. During usage, a wearer inserts their head into a crown 202's periphery opening with a headband of the hat in physical contact. Crown 202 may form a continuous rim that extends entirely around the wearer's head. Brim 204 typically projects forwardly and away from the wearer's head to shield their eyes, face, head, neck or any combination of the foregoing from overhead light, for example sunlight. When it is desired to reorient brim 204, for example to prevent wind from blowing on the lower surface of brim 204 thereby lifting the hat from the head, or to rapidly look upwardly to follow a flying ball, the wearer may rotate brim 204 with respect to crown 102 and the wearer's head without removing the hat.

Figure 3:
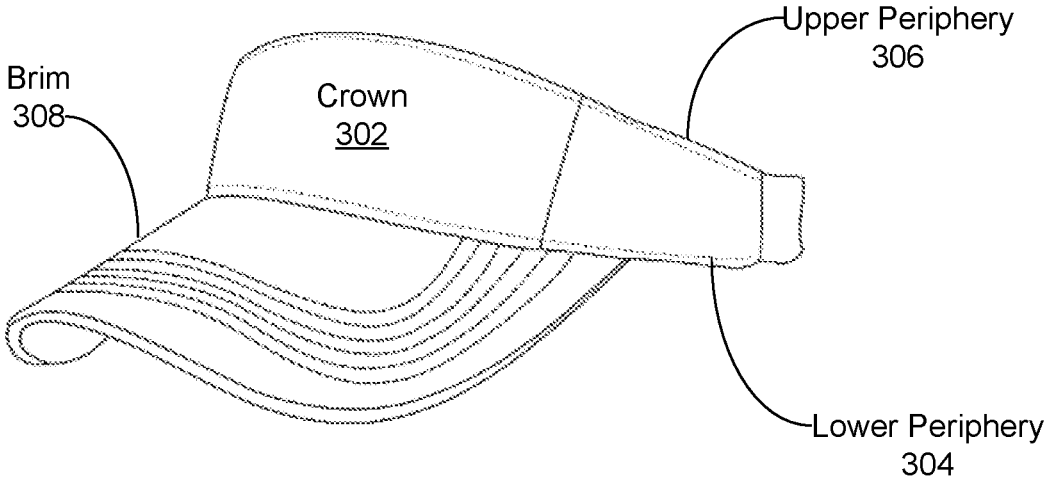
FIG. 3 is a top perspective view of a visor.

FIG. 3 is a top perspective view of a visor, which is another article or type of headgear relevant to the invention. Typically, the visor includes substantially the same components as the cap shown in shown in FIGS. 1A and 1B. However, the head-engaging portion or crown 302 can optionally cover less of a wearer's head, which can allow sunlight to shine through the top portion of the visor. Crown 302 may optionally be configured in a cylindrical shape or a shape of a band having a lower periphery 304 and an upper periphery 306, whereby the visor has an open bottom or lower opening, and an open top or upper opening, respectively. Both openings are configured to receive a wearer's head. Brim 308 may comprise an upper surface, a lower surface, and a proximate portion that is removably, adjustably or permanently secured to crown 302. The perimeter opposing the proximate portion of crown 302 may comprise an arcuate edge, which may facilitate shading of a wearer's eyes. Brim 308 may extend substantially horizontally away from crown 302 such that it provides shade for a wearer's eyes, face, head, neck or any combination of the foregoing. The visor can optionally include an adjustment at the rear, and may optionally comprise any mechanical means for modifying a fit to a wearer's head size, for example a Velcro strap, snap fasteners, clasp or buckle.

Other headgear, hats, caps and visors having a brim comprising a structural visor board are within the scope of the present invention.

Figure 4:
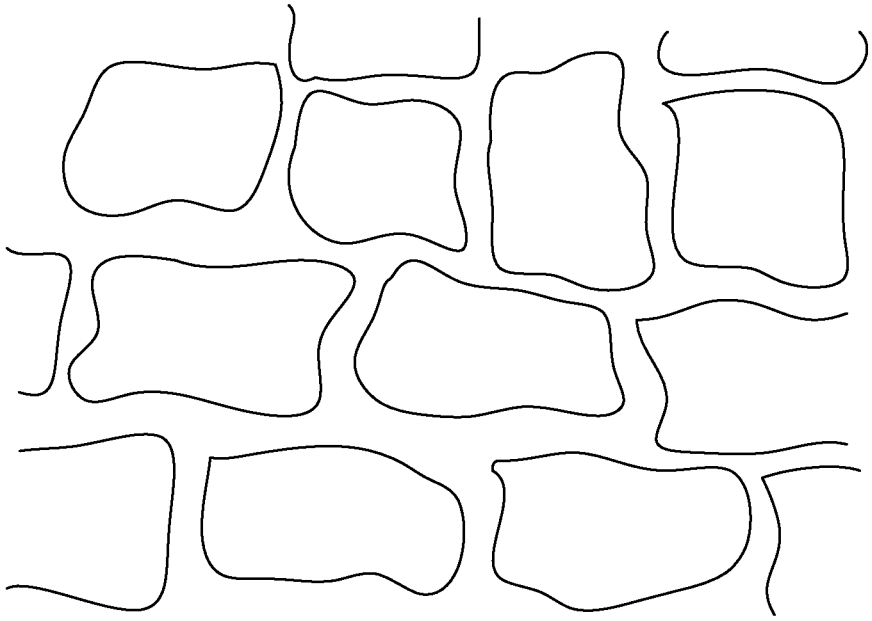
FIG. 4 is an enlarged view of the structure of cork.

FIG. 4 is an enlarged structural view of an embodiment of cork. The cork tissue may be compact, without intercellular voids, and may comprise a substantially honeycomb arrangement. Each individual cell may be dead parenchymateous cells with hollow, air-filled interiors. The cells are prismatic, hexagonal on average, and are stacked base-to-base in an alignment oriented in the tree's radial direction. The cell rows may be arranged parallel to one another.

Typically, after cork is harvested from trees, the bark is ground into granules or particles and then formed into sheets or molds. A binding agent or binder of any suitable type may be used to bond the individual granules or other particles together, for example to include agglomerated cork. Suitable binding agents include for example PVA glue, polyurethane, and natural rubber latex. Binding agents or binders of natural materials can optionally be utilized. Other binding agents, for example nylon, adhesive, plastic or thermoplastic may be utilized. Any combination of binding agents may optionally be utilized. Any combination of natural binding agents may optionally be utilized.

Figure 5A:
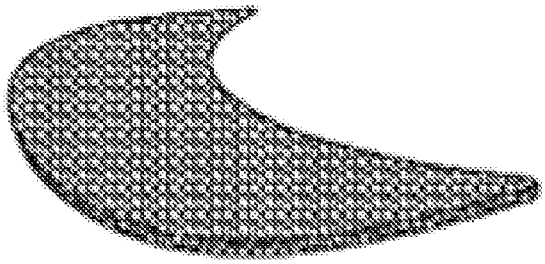
FIG. 5A is a perspective view of a headgear visor board made from solid cork.

FIG. 5A illustrates a brim of the invention made from solid cork. The brim may be flat and crescent-shaped, configured to physically attach with a lower periphery of a hat crown. Light, for example from the sun, may be blocked by the brim. The brim may comprise an upper surface, a lower surface, and a proximate portion that is removably, adjustably or permanently secured to the crown. Fabric, for example cotton or any other suitable textile, may be sewn onto the upper surface, lower surface, and edges of the cork brim. The brim of FIG. 5A can optionally be made from any suitable agglomerated cork, including for example any agglomerated cork having only natural binders.

Figure 5B:
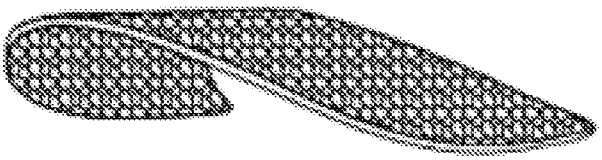
FIG. 5B is a perspective view of a headgear visor board of FIG. 5A in a curved configuration.

FIG. 5B illustrates the brim of FIG. 5A in a curved configuration. The purpose for which the headgear is to be used may dictate the brim's shape, length and angle. For example, the brim may be curved or bent along the direction from the periphery of the crown to the farthest edge in order to achieve more light coverage over the corners of a wearer's eyes.

Figure 6:
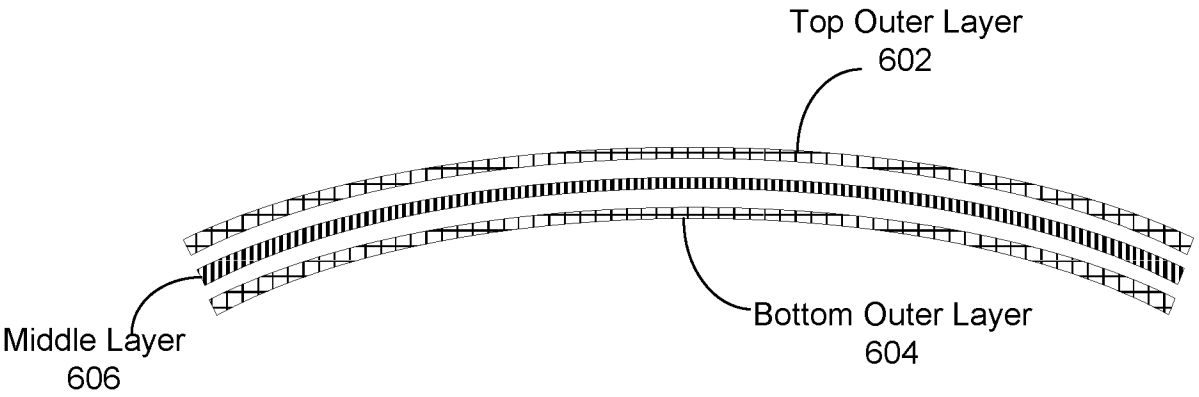
FIG. 6 is a front cross-sectional view of a multilayered hat visor board.

FIG. 6 is a front cross-sectional view of a multilayered hat brim of the invention. The layers may comprise any of the layers or combination of layers disclosed herein. For example, the layers may optionally comprise cork, bamboo, fabric, wood, jute, another suitable material or any combination of the foregoing. For example, top outer layer 602 and bottom outer layer 604 may be made from a different material, for example cork or another sewable natural material that is formable or moldable, than middle layer 606, which can optionally be made from bamboo or any other suitable strengthening material. Layers 602 and 604 may be made from different materials. Middle layer 606 may be disposed between top layer 602 and bottom outer 604. The three layers may optionally be physically attached together, for example laminated together, by any suitable connecting means, for example an adhesive or sewn together. For example, the layers may be assembled with a rubber or other natural adhesive in order to maintain biodegradability. It is appreciated, however, that any other adhesive element, whether natural or not, may be used. The choice of the adhesive may be determined by levels of rigidity, flexibility, water-resistance, sustainability or any combination of the foregoing.

Top outer layer 602 and bottom outer layer 604, and middle layer 606 can optionally be of the same dimensions. Such layers can optionally be of different dimensions. For example, bottom outer layer 604 may have one or more smaller dimensions, for example length, width, height or any combination of the foregoing, than middle layer 606 and top outer layer 602. In this manner, a natural downward bend or curve can optionally be formed. One or more dimensions of top outer layer 602 can optionally be larger than one or more dimensions of middle layer 606, which may in turn can optionally have one or more dimensions that are larger than bottom outer layer 606, for example to optionally further strengthen the natural downward bend or curve. One or more dimensions of top outer layer 602 and bottom outer layer 604 can optionally be the same, but optionally differ from one or more dimensions of middle layer 606.

As shown, the visor board may optionally be curved along the direction from a crown's periphery towards its outermost edge. It is appreciated, however, that a flat brim is within the scope of this disclosure. It is appreciated that the brim may be of any shape, for example crescent, square or oval, and of any size.

Figure 7:
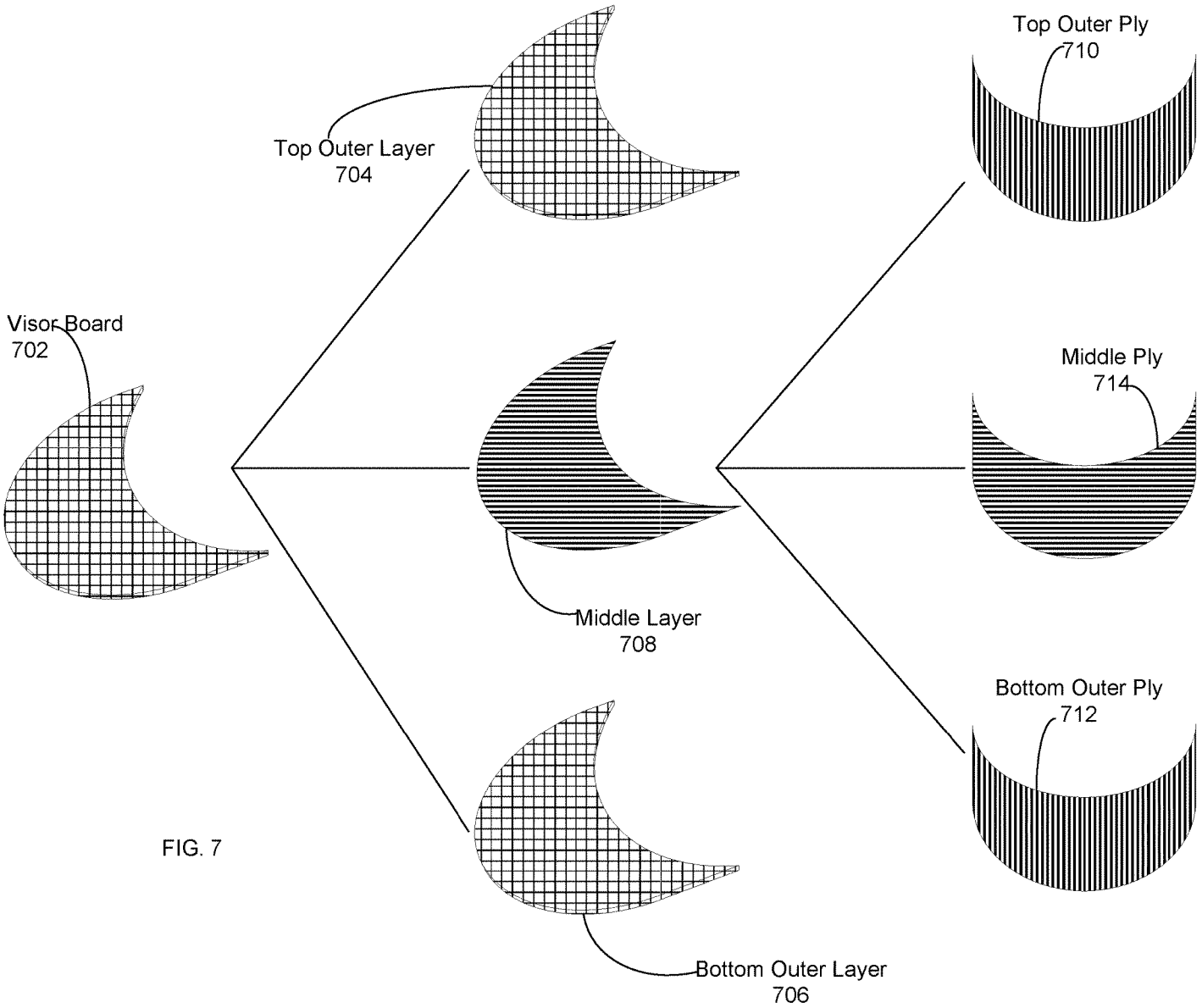
FIG. 7 is a schematic exploded diagram of a layering hierarchy of an embodiment of a cork and bamboo headgear visor board.

FIG. 7 is a schematic diagram of a layering hierarchy of a cork and bamboo brim of the invention. visor board 702's construction may optionally comprise three principal layers of material, for example a top outer layer 704 and bottom outer layer 706 made from cork boards, and a 3-ply bamboo middle layer 708. The bamboo middle layer 708 may comprise cross-laminated top outer ply 710 and bottom outer ply 712 that run parallel to each other, and a middle ply 714 that is perpendicular to the outer plies, creating directional flex in the visor board structure and permitting it to be curved in a fixed position. Such a visor board construction may resist bending in the opposite direction. Top outer ply 710 or bottom outer ply 712 may optionally run parallel to middle ply 714, and the remaining ply runs perpendicular to middle ply 714. Top outer ply 710, bottom outer ply 712, and middle ply 714 are optionally oriented in the same direction, for example are all parallel to one another.

Top outer layer 704 and bottom outer layer 706 may be of any suitable thickness, for example 1/32". Middle layer 708 may also be of any suitable thickness, for example 0.9 mm. Middle ply 714 may optionally comprise any other amounts of plies, for example a single ply, dual plies, or four or more plies. Multiple plies may optionally alternate in direction, as discussed above with the 3-ply configuration, or they may be oriented in a single direction. Optionally, a sealant, for example wax oil or polyurethane may be applied to the edge or perimeter of the assembled brim layers for added water-resistance.

Any other combinations of the layers of visor board 702 are within the scope of this disclosure. It is appreciated the cross-laminated ply layers of bamboo or other multi ply layers of bamboo disclosed herein may optionally be utilized in any other brim construction utilizing bamboo, disclosed herein or otherwise, and may optionally be utilized for a strengthening layer of any other material disclosed herein or otherwise in any other brim constructions disclosed herein or otherwise.

A cork and bamboo, or other strengthening material, visor board of any configuration may exhibit water-resistance due to cork, and have flex, durability, and rebound properties resulting from the bamboo. A cork and bamboo, or other strengthening material, brim can be heat-molded to a wearer's preferred curvature for a lasting fit. Because cork and bamboo, or certain other strengthening materials, are buoyant, the brim may be easily retrieved from natural waterways to reduce pollution as they float on the surface. Another benefit of cork is its antimicrobial property, which makes cork brims suitable for athletic applications, and outdoor settings where exposure to water is likely. The cork and bamboo, or other strengthening material, visor board construction meets or exceeds the performance of plastic brims in many measurable attributes, for example flex, heat-moldability, and comfort. The strengthening material can be a natural material or a material that is not natural.

Figure 8A:
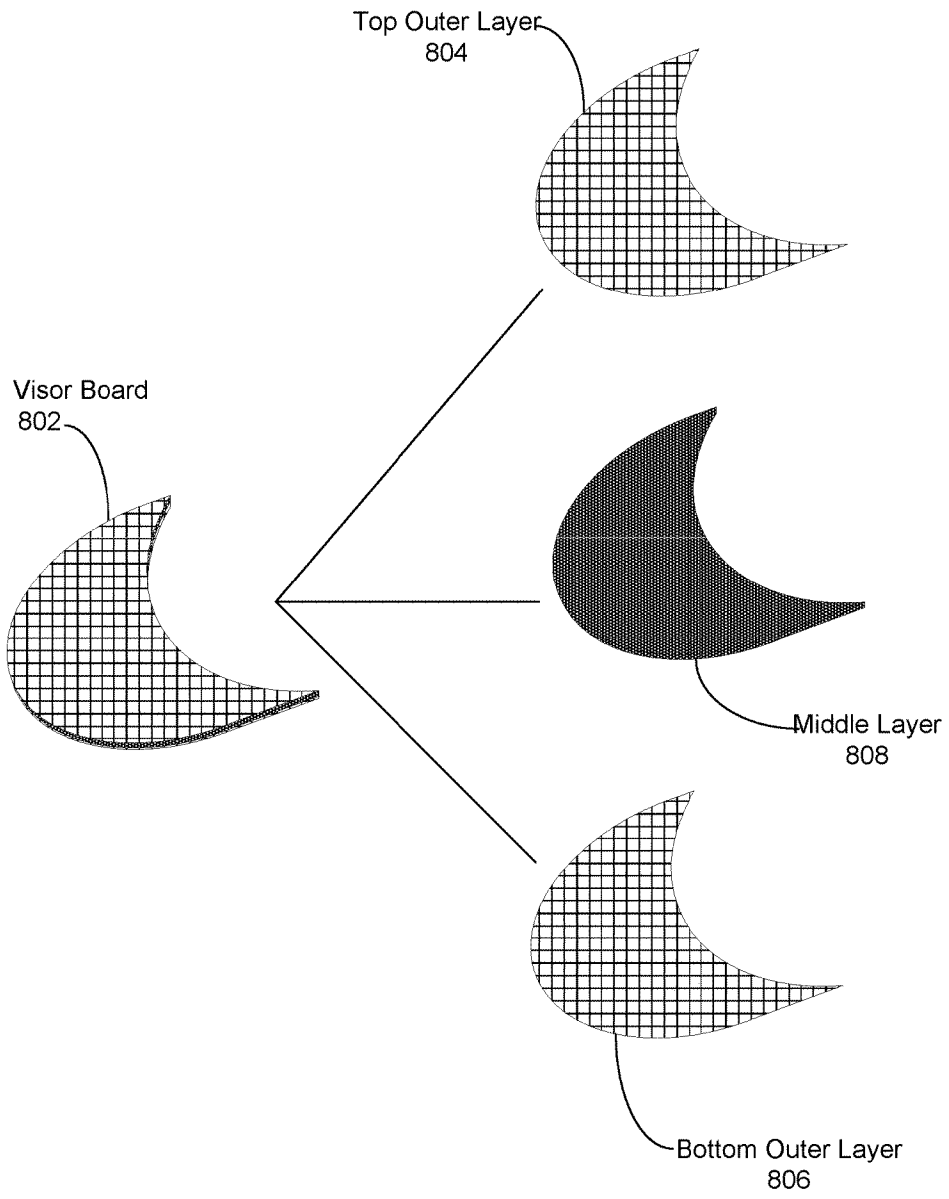
FIG. 8A is a schematic exploded diagram of a layering hierarchies of an embodiment of a cork and fabric headgear visor board.
Figure 8B:
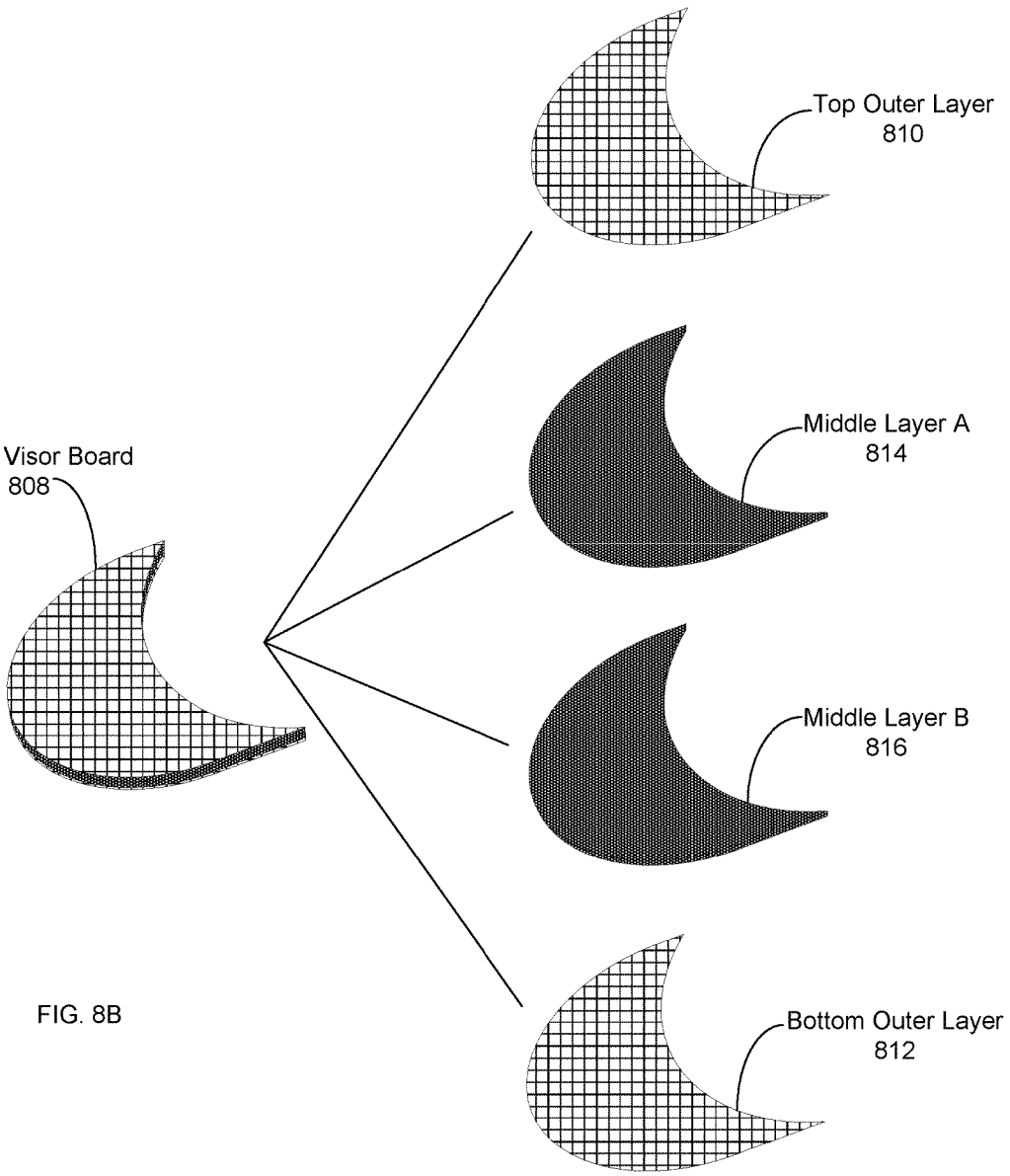
FIG. 8B is a schematic exploded diagram of a layering hierarchies of another embodiment of a cork and fabric headgear brim.
Figure 8C:
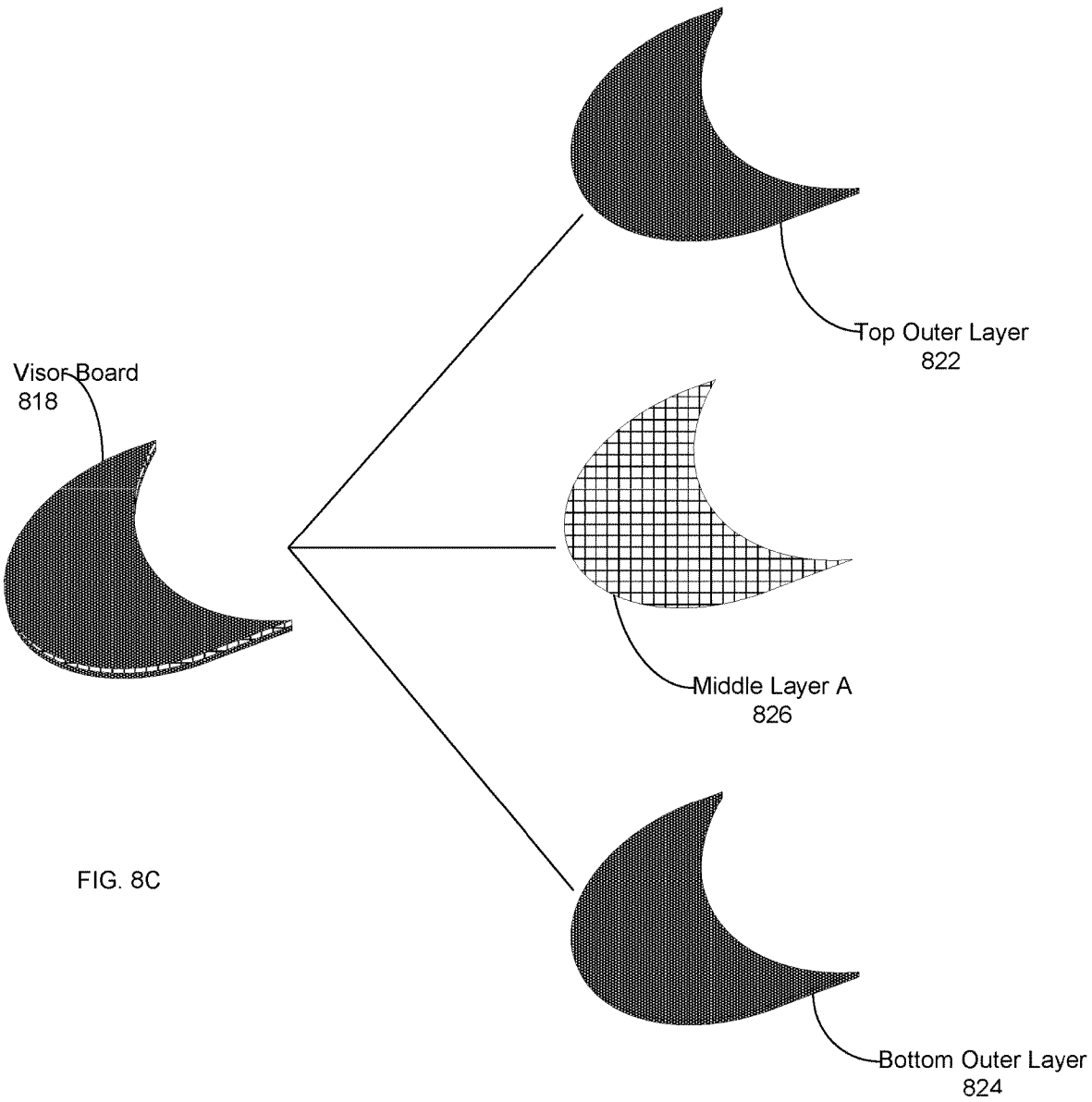
FIG. 8C is a schematic exploded diagram of a layering hierarchies of a further embodiment of a cork and fabric headgear visor board.

FIGS. 8A-C are schematic diagrams of layering hierarchies of a cork and fabric brim of the invention. FIG. 8A may be a visor board 802 comprising a single cork layer with fabric overlay. visor board 802 may be made up of top outer layer 804, bottom outer layer 806, and middle layer 808. Top outer layer 804 and bottom outer layer 806 may be made from fabric or any other textile, for example cotton, and middle layer 808 may be made from any suitable cork. For example, the fabric may be laminated to the top and bottom surfaces of a cork board of middle layer 808. The surface tension of the fabric permits the cork material to bend and return to its original shape, and the heat moldable character of the cork material permits construction of a curved brim that is flexible in multiple directions, allowing for a crushable, packable design that will rebound or return to its intended form. The layers of visor board 802 may be attached together by any suitable means. It is appreciated that layers 804, 806 may be made from any other suitable strengthening material or combinations thereof, for example any strengthening material disclosed herein.

FIG. 8B may be a visor board 808 comprising dual cork layers with a fabric overlay, for example on each side of the dual cork layers. visor board 808 may be made up of top outer layer 810, bottom outer layer 812, and middle layer A 814 and middle layer B 816. Top outer layer 810 and bottom outer layer 812 may be made from fabric or any other suitable textile, for example cotton. Middle layer A 814 and middle layer B 816 may be made from any suitable cork. Application of a plurality of cork layers, for example two or more, may facilitate the adjustments of flex, rigidity, and durability. The layers of visor board 808 may be attached together by any suitable means. It is appreciated that layers 810, 812 may be made from any other suitable strengthening material or combinations thereof, for example any strengthening material disclosed herein.

FIG. 8C illustrates a visor board 818 comprising dual cork layers with a middle fabric layer attached thereto. Brim 820 may be made up of top outer layer 822, bottom outer layer 824, and middle layer 826. Top outer layer 822 and bottom outer layer 824 may be made from any suitable cork. Middle layer 826 may be made from fabric or any other suitable textile, for example cotton. The fabric middle layer 826 in the construction of brim 818 may add durability to the visor board 818. The layers of visor board 818 may be attached together by any suitable means. It is appreciated that layer 826 may be made from any other suitable strengthening material or combinations thereof, for example any strengthening material disclosed herein.

Any other combinations of cork, a sewable natural material, a sewable bendable material, a sewable heat moldable material, sewable memory material, fabric, textile, bamboo, strengthening material are within the scope of the invention.

Figure 9:
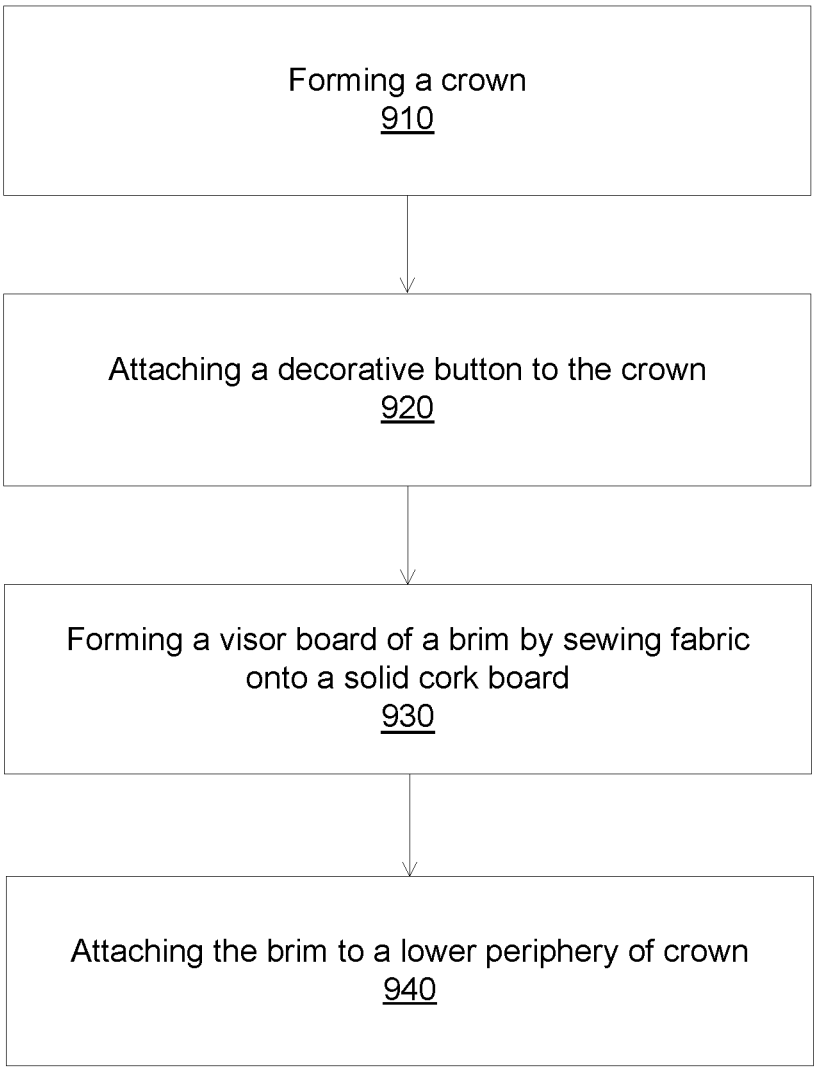
FIG. 9 is a flowchart of an embodiment of a method of manufacturing a hat having a solid cork visor board.

FIG. 9 is a flowchart of a method of manufacturing a hat, or other article of headgear, comprising a cork visor board. The cork material can be of any suitable type, for example solid cork or agglomerated cork. Operation 910 forms a crown portion, for example by sewing together six triangular segments or gores of a fabric or other suitable textile, for example cotton. A headband may optionally be sewn to an inside lower periphery of the crown. Operation 920 attaches a decorative button to the apex of the crown. Any type of fastener may be used to secure the button, including or example a snap fastener. Operation 930 forms a hat brim by sewing fabric onto a bulking layer, which bulking layer can optionally include one or more layers of cork, for example attached solid cork boards or a board comprising layers of cork. The bulking layer can optionally have any suitable strengthening material, for example bamboo, attached to it. The fabric may be made of any material or textile, for example cotton. Operation 940 attaches the brim to a lower periphery of a crown, strap or other headpiece. The brim may extend forwardly and away from the crown such that it covers overhead light for a wearer of the hat or other article of headgear.

Figure 10:
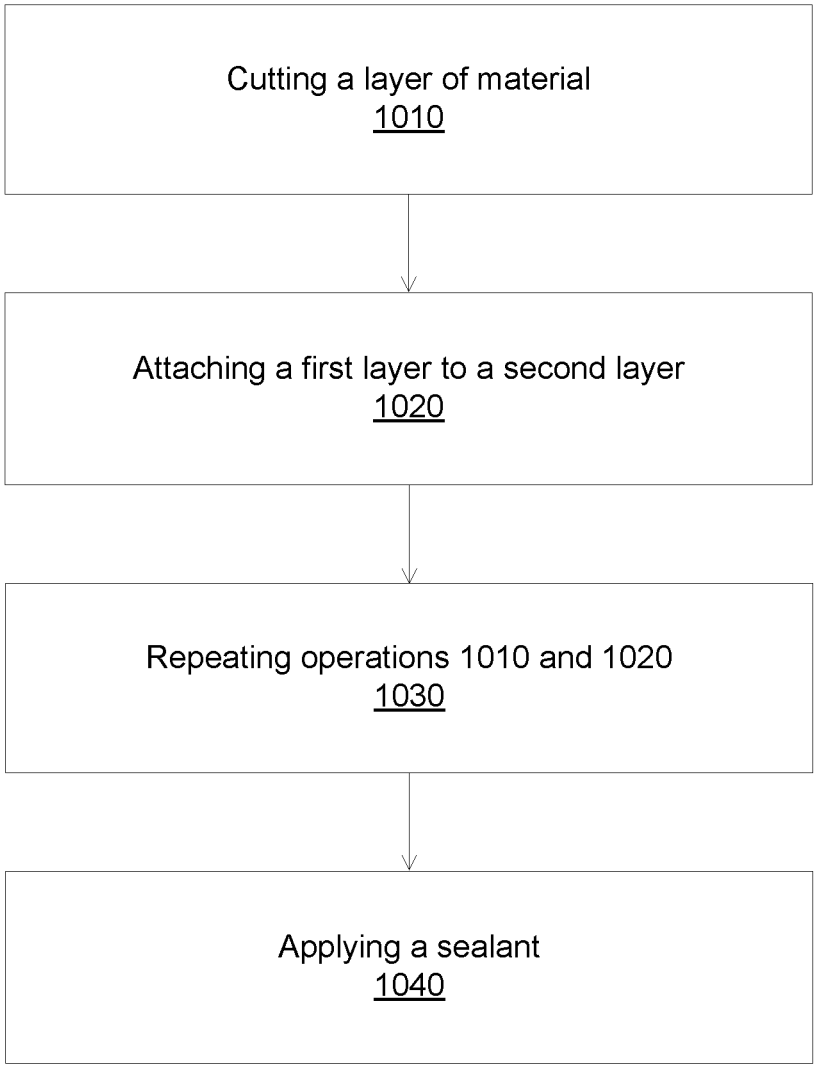
FIG. 10 is a flowchart of an embodiment of a method for attaching a plurality of headgear visor board layers, in which the brim layers may comprise the same material, or different materials.

FIG. 10 is a flowchart of a method for attaching a plurality of layers of a visor board. The visor board layers may comprise the same material, or different materials. The materials can include any of the visor board materials disclosed herein and any combination of such materials, including for example cork or other sewable bulking layer, bamboo, fabric, wood, jute or any other strengthening layer. Operation 1010 includes cutting a layer of material to be used in a construction of the brim to predetermined dimensions. The device used for cutting can range from industrial machines to common house products such as scissors or a cutting blade. Operation 1020 includes attaching a first layer to a second layer by any suitable means, including by any mechanical connector, being sewn, a chemical connector, an adhesive or any combination of the foregoing. For example, the layers may be assembled with a natural rubber adhesive, or any other suitable adhesive, in order to maintain biodegradability. The choice of adhesive may optionally be determined by levels of rigidity, flexibility, water-resistance, sustainability or any combination of the foregoing factors. Operation 1030 repeats operation 1010 and operation 1020 as many times as additional layers of the brim are desired, for example one or more times. Operation 1040 applies a sealant of any suitable type, for example wax oil, to the edge or perimeter of the assembled brim layers for added water-resistance.

Although the present embodiments have been described with reference to specific examples, it will be evident that various modifications and changes may be made to these examples without departing from the broader spirit and scope. In addition, the components shown in the figures, their connections, couples, and relationships, and their functions, are meant to be exemplary only, and are not meant to limit the examples described herein.

A number of examples have been described. Nevertheless, it will be understood that various modifications may be made without departing from the spirit and scope of the claimed invention. In addition, the logic flows depicted in the figures do not require the particular order shown, or sequential order, to achieve desirable results. Other steps may be provided, or steps may be eliminated, from the described flows, and other components may be added or removed. Accordingly, other examples are within the scope of the following claims.

We claim:

1. A biodegradable visor board for use in a headgear brim comprising a crushable multilayer structure having multilayer bamboo for serving as a strengthening layer and providing flex and rebound to the multilayer structure and a sewable layer of cork laminated to the multilayer bamboo for permitting the multilayer structure to be sewn by an industrial sewing machine, whereby the multilayer structure provides a packable design, is a viable replacement for plastic visor boards and exceeds the performance of plastic visor boards in flex, rebound and comfort.

2. The visor board of claim 1, further comprising a textile layer overlying the multilayer structure for providing a desired aesthetic appearance.

3. The visor board of claim 1, wherein the cork is selected from the group consisting of solid cork, agglomerated cork and a combination of the foregoing.

4. The visor board of claim 3, wherein the agglomerated cork includes cork particles agglomerated with a binder selected from the group consisting of polyurethane, PVA glue, rubber, natural rubber, nylon, adhesive, plastic, thermoplastic or any combination of the foregoing.

5. The visor board of claim 1, further comprising an additional sewable layer of cork laminated to the multilayer bamboo such that the multilayer bamboo extends between the first-named sewable layer of cork and the additional sewable layer of cork.

6. The visor board of claim 1, wherein the multilayer bamboo has directional flex for facilitating bend along one axis and resisting bending along another axis for desirable brim flex characteristics.

7. The visor board of claim 1, wherein the multilayer bamboo has cross laminated ply layers.

8. A biodegradable visor board for use in a headgear brim comprising a crushable multilayer structure of first and second layers of a foam material that is sewable in an industrial process and a multilayer bamboo laminated between the first and second layers of the foam material and having cross laminated ply layers for providing strength, flex and rebound to the multilayer structure, whereby the multilayer structure provides a packable design, is a viable replacement for plastic visor boards and exceeds the performance of plastic visor boards in flex, rebound and comfort.

9. The visor board of claim 8, wherein the foam material has a memory for permitting the material to retain a shape.

10. The visor board of claim 8, wherein the foam material is heat moldable.

11. The visor board of claim 8, wherein the foam material is selected from the group consisting of cork, agglomerated cork, a plastic-free foam, foam, a natural material, a sewable material, a sewable substrate and any combination of the foregoing.

12. A biodegradable visor board for use in a headgear brim comprising a crushable multilayer structure having first and second layers of sewable agglomerated cork and a multilayer bamboo laminated between the first and second layers of agglomerated cork and having cross laminated ply layers for providing strength, flex and rebound to the multilayer structure, whereby the multilayer structure is sewable in an industrial process, provides a packable design, is a viable replacement for plastic visor boards and exceeds the performance of plastic visor boards in flex, rebound and comfort.

13. The visor board of claim 12, wherein each of the first and second layers of agglomerated cork includes cork particles agglomerated with a binder selected from the group consisting of polyurethane, PVA glue, rubber, natural rubber, nylon, adhesive, plastic, thermoplastic or any combination of the foregoing.

14. The visor board of claim 12, further comprising a textile layer overlying the multilayer structure for providing a desired aesthetic appearance to the headgear brim.

15. The visor board of claim 12, wherein each of the first and second layers of agglomerated cork is heat moldable.

16. The visor board of claim 12, wherein each of the first and second layers of agglomerated cork has a memory for permitting the layer to retain a shape.

* * * * *